US006367458B1

(12) United States Patent
Furusho et al.

(10) Patent No.: US 6,367,458 B1
(45) Date of Patent: Apr. 9, 2002

(54) LEAK DIAGNOSTIC DEVICE FOR IN-TANK CANISTER SYSTEM

(75) Inventors: Masaya Furusho, Yokohama; Katsunori Ozaki, Ishihara, both of (JP)

(73) Assignee: Nissan Motor Co., Ltd., Kanagawa (JP)

( * ) Notice: Subject to any disclaimer, the term of this patent is extended or adjusted under 35 U.S.C. 154(b) by 8 days.

(21) Appl. No.: 09/633,864

(22) Filed: Aug. 7, 2000

(30) Foreign Application Priority Data

Oct. 8, 1999 (JP) ..... 11-226148
Jan. 6, 2000 (JP) ..... 2000-164404

(51) Int. Cl.[7] ..... F02N 33/02; F02N 25/08
(52) U.S. Cl. ..... 123/519; 123/198 D; 73/118.1
(58) Field of Search ..... 123/514, 516, 123/518, 519, 520, 521, 522, 523, 198 D; 137/576, 565.13, 565.17, 565.34, 588, 592; 73/118.1, 49.7

(56) References Cited

U.S. PATENT DOCUMENTS 4,852,761 A * 8/1989 Turner et al. ..... 123/519
5,474,048 A * 12/1995 Yamazaki et al. ..... 123/519
5,630,445 A * 5/1997 Horiuchi et al. ..... 137/592
5,679,890 A * 10/1997 Shinohara et al. ..... 73/118.1
5,750,888 A * 5/1998 Matsumoto et al. ..... 73/118.1
5,855,198 A * 1/1999 Nakajima et al. ..... 123/520
5,881,698 A * 3/1999 Tuckey et al. ..... 123/497
6,000,426 A * 12/1999 Tuckey et al. ..... 137/588
6,182,693 B1 * 2/2001 Stack et al. ..... 137/565.17
6,240,908 B1 * 6/2001 Hyodo et al. ..... 123/516
6,273,070 B1 * 8/2001 Arnal et al. ..... 123/519
6,276,343 B1 * 8/2001 Kawamura et al. ..... 123/520
6,302,144 B1 * 10/2001 Graham et al. ..... 137/565.17

FOREIGN PATENT DOCUMENTS

JP 5-195881 A 8/1993

* cited by examiner

*Primary Examiner*—Tony M. Argenbright
*Assistant Examiner*—Hai Huynh
(74) *Attorney, Agent, or Firm*—Shinjyu Global IP Counselors, LLP

(57) ABSTRACT

A leak diagnostic device is provided to detect leaks at any parts of an in-tank canister system. The three-way control valve 30 may be switched while the purge control valve 24 remaining open to negatively pressurize the interior of the fuel tank 1 while the interior of the canister 2 being maintained at about atmospheric pressure. Upon negatively pressurizing the interior of the fuel tank 1, the purge control valve 24 is closed, and then leaks are checked based on a change in the negative pressure within the fuel tank 1.

20 Claims, 6 Drawing Sheets

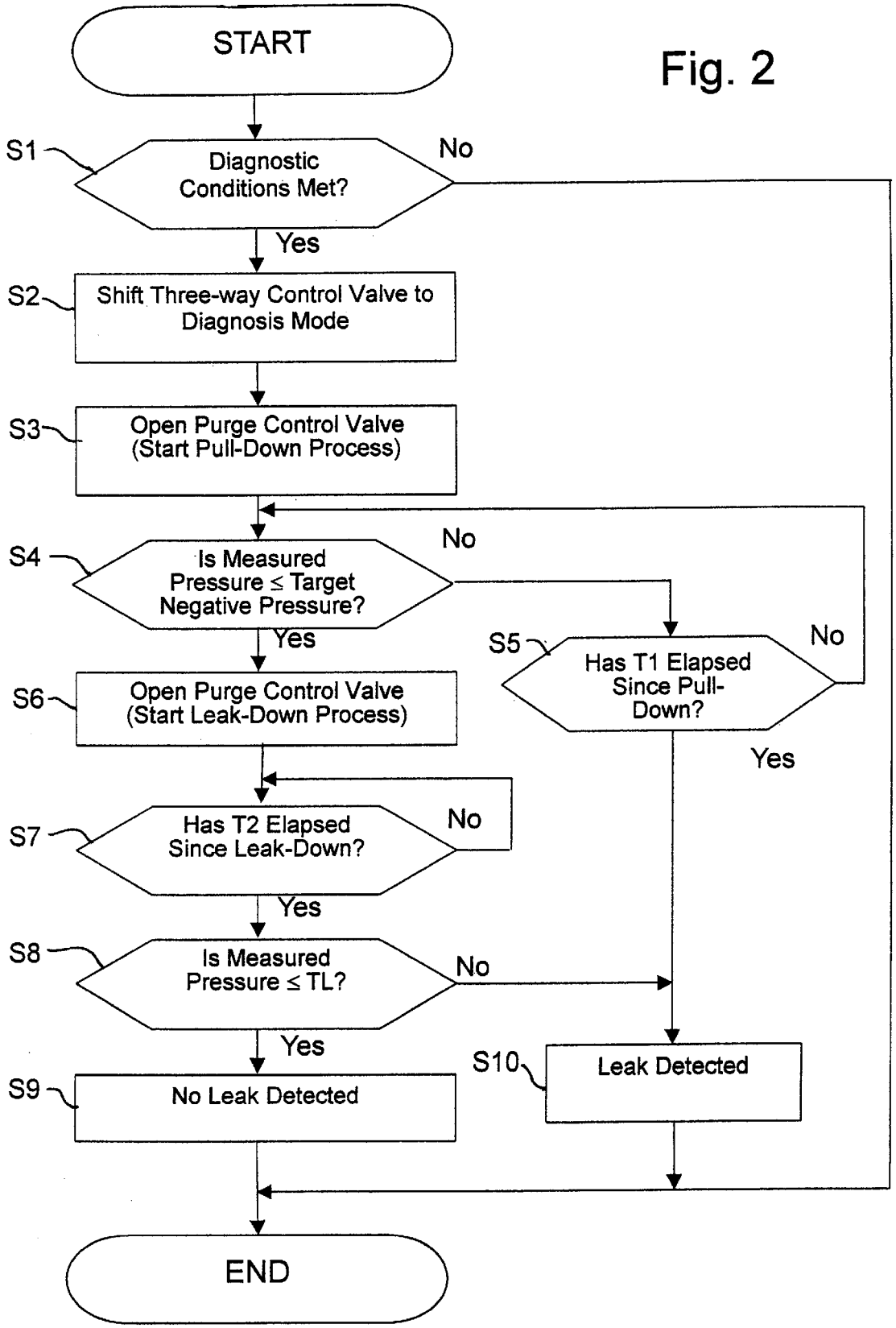
START
Fig. 2
S1
Diagnostic Conditions Met?
No
Yes
S2
Shift Three-way Control Valve to Diagnosis Mode
S3
Open Purge Control Valve (Start Pull-Down Process)
S4
Is Measured Pressure ≤ Target Negative Pressure?
No
Yes
S5
Has T1 Elapsed Since Pull-Down?
No
Yes
S6
Open Purge Control Valve (Start Leak-Down Process)
S7
Has T2 Elapsed Since Leak-Down?
No
Yes
S8
Is Measured Pressure ≤ TL?
No
Yes
S9
No Leak Detected
S10
Leak Detected
END

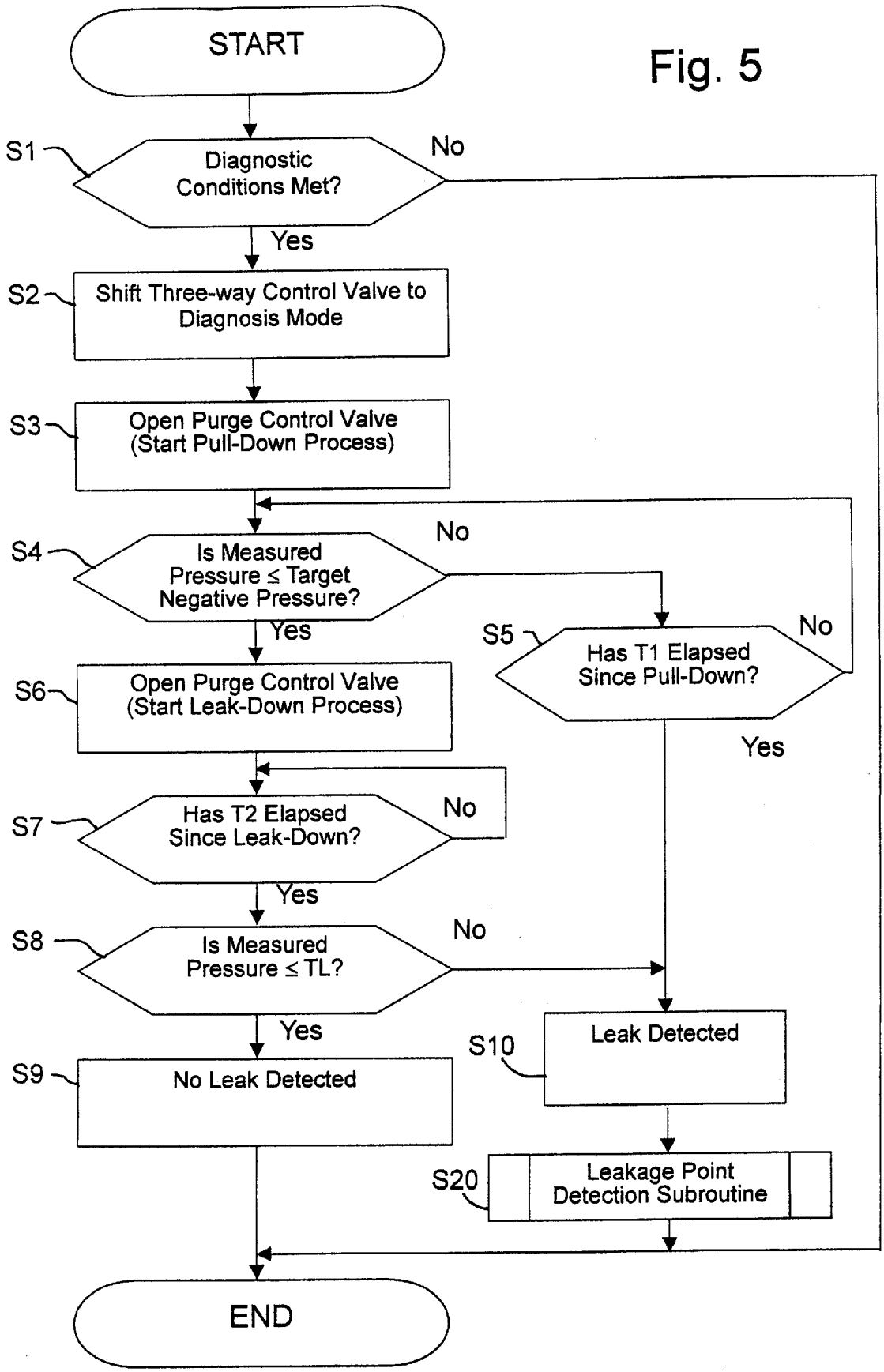
START
Fig. 5
S1
Diagnostic Conditions Met?
No
Yes
S2
Shift Three-way Control Valve to Diagnosis Mode
S3
Open Purge Control Valve (Start Pull-Down Process)
S4
Is Measured Pressure ≤ Target Negative Pressure?
No
Yes
S5
Has T1 Elapsed Since Pull-Down?
No
Yes
S6
Open Purge Control Valve (Start Leak-Down Process)
S7
Has T2 Elapsed Since Leak-Down?
No
Yes
S8
Is Measured Pressure ≤ TL?
No
Yes
S9
No Leak Detected
S10
Leak Detected
S20
Leakage Point Detection Subroutine
END

LEAK DIAGNOSTIC DEVICE FOR IN-TANK CANISTER SYSTEM

BACKGROUND OF THE INVENTION

1. Field of the Invention

This invention generally relates to a leak diagnostic device for a fuel vapor processing device of an internal combustion engine. More specifically, the present invention relates to a leak diagnostic device for an in-tank canister system.

2. Background Information

A fuel vapor processing device is a device for preventing fuel vapor inside a fuel tank from being dispersed into surrounding atmosphere. There have been fuel vapor processing devices for internal combustion engines, in which fuel vapor vaporized in a fuel tank is guided to and is temporally absorbed in a canister. Inside the canister, activated carbon absorbs the fuel vapor, such that the fuel vapor is not discharged to the atmosphere. The fuel vapor absorbed in the canister is thereafter purged out of the canister into a suction system of the internal combustion engine via a purge control valve, as air flows in from an air inlet opening. In this manner, dispersion of the fuel vapor from the fuel tank into the surrounding atmosphere can be avoided.

However, if such vapor processing device has a hole, crack or seal failure in its fuel tank, canister and/or the conducting pipes, it causes a leakage of the fuel vapor. In other words, the vapor processing device cannot properly prevent the dispersion of the fuel vapor into the surrounding atmosphere.

To address such problem, a diagnostic system that diagnoses a leakage by using negative pressure measurements has been proposed as a leak diagnostic device for diagnosing leaks in a purge line, as well as a fuel tank and a canister. (Japanese Unexamined Patent Publication No. 5-195881)

In this system, a leak diagnosis is performed at a predetermined timing during operation of the internal combustion engine. As the leak diagnosis starts, the air inlet passage that leads to the canister is closed at a cutoff valve or drain cut valve, while keeping the purge control valve open. As a result, the fuel vapor and air inside the canister are purged out of the canister to the suction system of the internal combustion engine, but air does not flow in from the air inlet passage. Therefore, negative pressure is effected in the fuel tank and the canister, as well as in the purge line that connects the canister and the suction system. Then, the purge control valve, which is located between the canister and the suction system, is closed. Thereafter, a change in the negative pressure within the fuel tank is continuously measured by a pressure sensor. After a predetermined period of time elapses, the leak diagnostic system determines whether there is a leak, based on the measurement of the negative pressure. That is, if the negative pressure within the fuel tank remains the same, there is no leak in the purge line, the fuel tank, or the canister. If, on the other hand, the negative pressure within the fuel tank has decreased and become closer to the atmospheric pressure, there is a leak. Even if the leak takes place in the canister, the leak affects the pressure in the purge line and the fuel tank. Therefore, once a leak is detected, the leak can be in any of the purge line, the fuel tank, and the canister. This determination is made with reference to a predetermined threshold level pressure. If the negative pressure of the fuel tank is equal to or greater than the threshold level after the predetermined period of time, there is no leak. Conversely, if the pressure is smaller than the threshold level and is approaching the atmospheric pressure, there is a leak somewhere in the purge line, fuel tank, and the canister.

In recent years, there has been proposed a fuel vapor processing device of an internal combustion engine for use in an in-tank canister system, as seen in Japanese Unexamined Patent Publication No. 10-184476. The in-tank canister system has a canister within a fuel tank. This system is preferable in that it can dispose most of the conducting pipes within the fuel tank. Therefore, dispersion of fuel vapor from rubber hoses and joints that connect the fuel tank and the canister does not necessarily result in dispersion of fuel vapor out of the fuel tank.

In order to apply the aforesaid leak diagnosis that uses negative pressure measurements in an in-tank canister system, a cutoff valve or drain cut valve that controls the flow of air must be disposed in the air inlet passage between the canister and the air inlet opening. In the case of the in-tank canister system, the canister is inside the fuel tank, while the air inlet opening is outside the fuel tank. The cutoff valve should be disposed outside the fuel tank, since the cutoff valve is generally formed of a solenoid valve, and it is not desirable to dispose an electrical component such as a solenoid valve in the fuel tank.

To perform the leak diagnosis in this type of in-tank canister system, first the cutoff valve is closed, while the purge valve is kept open to create negative pressure within the fuel tank and the canister. Then, the purge control valve is closed to perform the leak diagnosis. However in this leak diagnosis, if there is a hole in the canister, the hole will not be detected. This is because the pressure within both the fuel tank and the canister is negative. Since the pressure inside the fuel tank is the same as the pressure inside the canister, the pressure inside the fuel tank will not be affected even if there is a hole in the canister.

In another type of in-tank canister system, a check valve or negative pressure cut valve is disposed in a fuel vapor inlet passage that guides the fuel vapor to the canister from the fuel vapor inlet opening. The fuel vapor opening opens to the upper interior space of the fuel tank. In this type of in-tank canister system, a bypass passage is disposed so as to bypass the negative pressure cut valve. Also, a bypass valve is disposed in the bypass passage such that the bypass valve opens only during the leak diagnosis to create negative pressure within the fuel tank. Therefore, to perform leak diagnosis in this type of in-tank canister system, both the cutoff valve and the bypass valve must be provided, which leads to an undesired increase in the number of the components required.

In view of the above, there exists a need for a leak diagnostic device which overcomes the above mentioned problems in the prior art. This invention addresses this need in the prior art as well as other needs, which will become apparent to those skilled in the art from this disclosure.

SUMMARY OF THE INVENTION

Accordingly, an object of the present invention is to provide a leak diagnostic device that can detect leaks at any parts of the in-tank canister system that is related to a release of the fuel vapor.

Another object of the present invention is to provide a leak diagnostic device that requires a fewer number of parts.

Still another object of the present invention is to provide a leak diagnostic device that can detect a leak as well as a leakage point in an in-tank canister system.

The foregoing objects can basically be attained by providing a leak diagnostic device for an in-tank canister system connected to a suction system of an internal combustion engine. The in-tank canister system includes a fuel tank, fuel tank, a vapor absorbing canister, a fuel vapor inlet passage, an air inlet passage, and a purge passage. The fuel vapor inlet passage fluidly connects a fuel vapor inlet opening disposed in an upper interior space of the fuel tank to the canister via a negative pressure cut valve. The air inlet passage draws air into the canister through an air inlet opening disposed outside the fuel tank. The purge passage purges the fuel vapor along with air out of the canister into the suction system of the internal combustion engine via a purge control valve. The leak diagnostic device comprises a negative pressure control valve and a control unit. The negative pressure control valve is arranged to operatively connect and disconnect the suction system between the canister in a normal mode and the upper interior space of the fuel tank in a diagnosis mode. The control unit has a pressure sensor arranged to measure pressure in the upper interior space of the fuel tank. The control unit is operatively coupled to the negative pressure control valve to shift the negative pressure control valve between the normal mode and the diagnosis mode. The control unit is configured to open the purge control valve with said negative pressure control valve in said normal mode to create a negative pressure in the fuel tank and to determine whether there is a leak based on the pressure measured by said pressure sensor.

These and other objects, features, aspects and advantages of the present invention will become apparent to those skilled in the art from the following detailed description, which, taken in conjunction with the annexed drawings, discloses preferred embodiments of the present invention. The features of the present invention that are believed to be novel are set forth with particularity in the appended claims.

BRIEF DESCRIPTION OF THE DRAWINGS

Referring now to the attached drawings which form a part of this original disclosure:

FIG. 2 is a flow chart of the leak diagnosis in accordance with the first embodiment of the present invention;

FIG. 5 is a flow chart of the leak diagnosis in accordance with the second embodiment of the present invention.

DETAILED DESCRIPTION OF THE PREFERRED EMBODIMENTS

Figure 1:
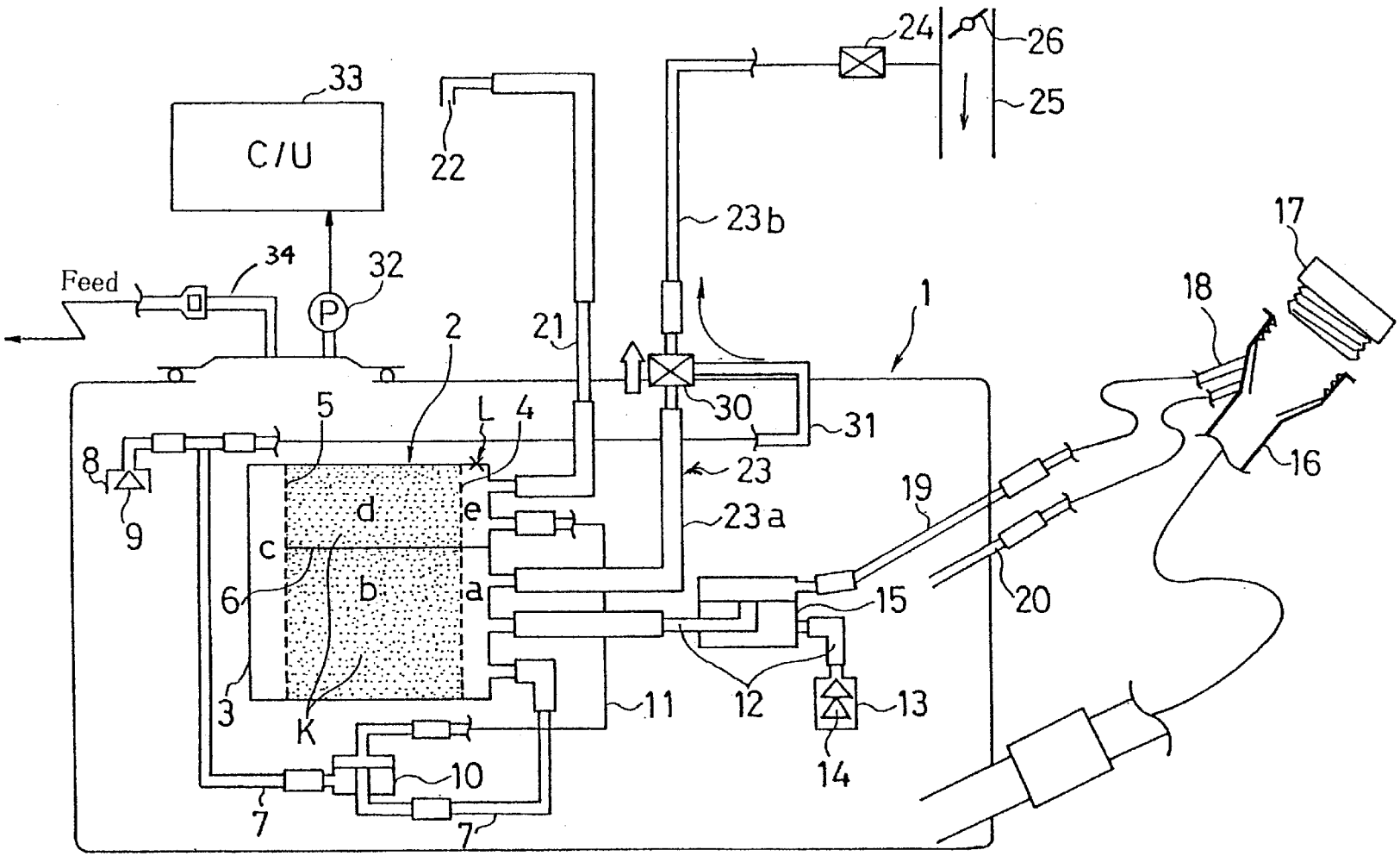
FIG. 1 is a schematic structural diagram of an in-tank canister system having a leak diagnostic feature in accordance with the first embodiment of the present invention.
Figure 4:
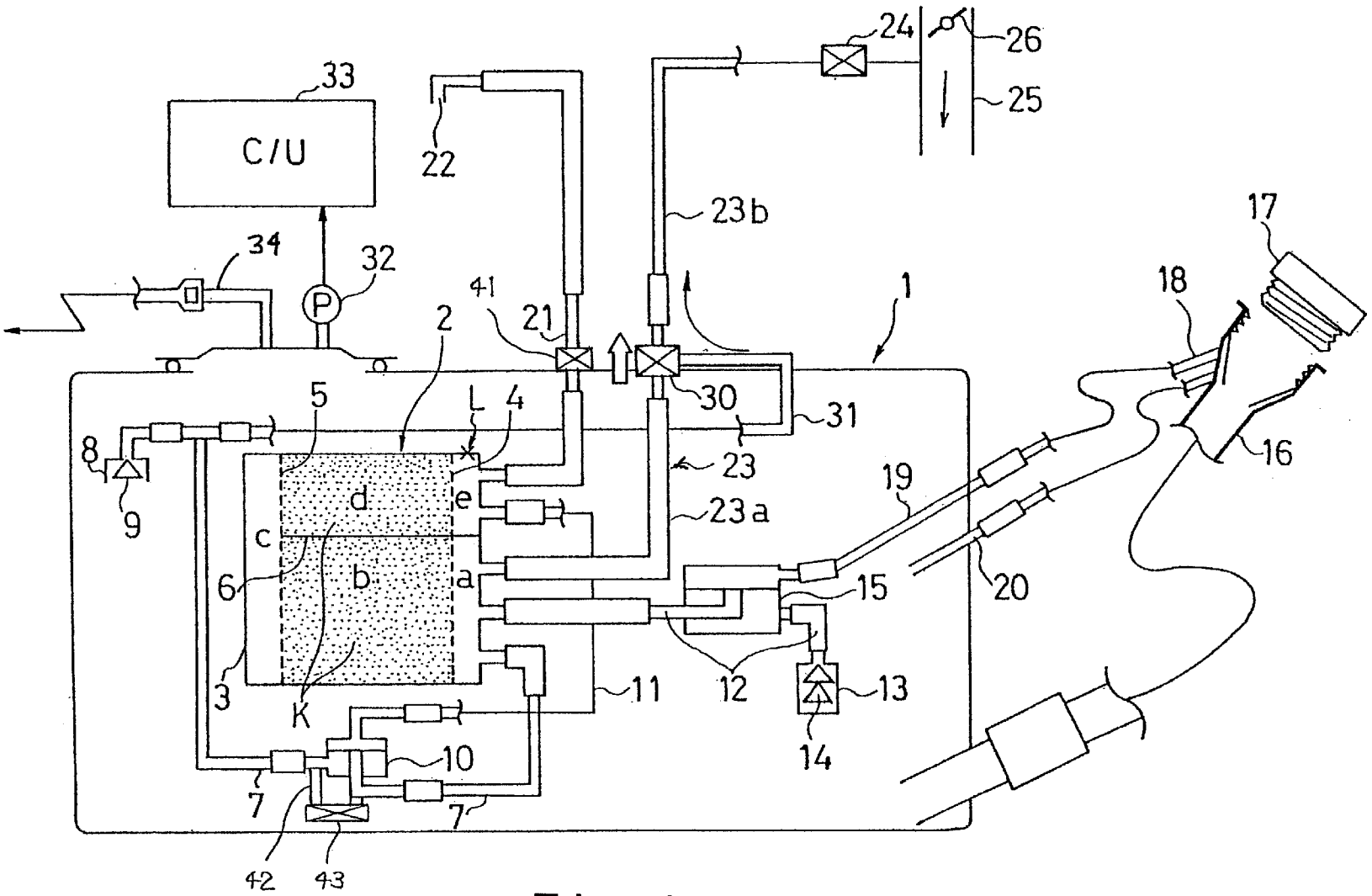
FIG. 4 is a schematic structural diagram of an in-tank canister system having a leak diagnostic feature in accordance with a second embodiment of the present invention.

Embodiments of the present invention will be described with reference to the accompanying drawings. FIG. 1 is a schematic structural diagram of an in-tank canister system having a leak diagnostic feature in accordance with a first embodiment of the present invention. It should be understood to those skilled in the art from this disclosure that the drawings are intended to illustrate only connections between various components of the present invention. The drawings are not intended to illustrate other components not directly related to the present invention. Furthermore, the drawings of FIGS. 1 and 4 are not intended to illustrate vertical locations of the components relative to each other, especially the vertical locations of components relative to the location of fuel within the fuel tank.

A fuel tank 1 supplies fuel to an internal combustion engine through a fuel feeder 34. The fuel is refilled through a filler tube 16. Fuel vapor within the fuel tank 1 is supplied to the internal combustion engine through a purge passage 23. External air is drawn into the fuel tank 1 through an air inlet passage 21.

A vapor absorbing canister 2 is arranged inside the fuel tank 1. The canister 2 is divided into five chambers, a-e within a casing 3. The chambers a-e are separated by gas permeable screens 4 and 5 and a partition plate 6. The fuel vapor flows through these chambers in the order of a-b-c-d-e. The chambers b and d contain adsorbents K such as activated carbon in order to absorb fuel vapor particles. The precise construction of canister 2 is not important to the present invention, except as explained below. Accordingly, it will be apparent to those skilled in the art that the canister 2 can have any construction that will carry out the function of absorbing fuel vapor particles.

A fuel vapor inlet passage 7 is connected to the chamber a of the canister 2. The fuel vapor inlet passage 7 guides the fuel vapor from a fuel vapor inlet opening 8 to the chamber a of the canister 2. The fuel vapor inlet opening 8 is arranged in an upper interior space of the fuel tank 1. In other words, the fuel vapor inlet opening 8 is located in a space within the fuel tank 1 that is above the full fuel level.

The fuel vapor inlet opening 8 opens in a downward direction. The fuel vapor inlet opening 8 has a fuel cut valve 9 at its end to prevent liquid fuel from flowing into the fuel vapor inlet opening 8 if the fuel level reaches the level of the fuel vapor inlet opening 8.

A check valve or negative pressure cut valve 10 is disposed in the fuel vapor inlet passage 7 between the fuel vapor inlet opening 8 and the chamber a of the canister 2. The negative pressure cut valve 10 is preferably a diaphragm valve having a chamber above a diaphragm. The chamber of the negative pressure cut valve 10 is supplied with air from the chamber e of the canister 2 through an atmospheric pressure inlet passage 11, such that the pressure inside of the chamber of the negative pressure cut valve 10 is kept at a substantially atmospheric pressure. Therefore, as the fuel vapor is supplied from the fuel vapor inlet opening 8, the diaphragm of the negative pressure cut valve 10 is pushed upward by the pressure of the fuel vapor. The negative pressure cut valve 10 opens when the pressure of the fuel vapor coming through the fuel vapor inlet opening 8 is above the atmospheric pressure inside the chamber of the negative pressure cut valve 10. Conversely, as the negative pressure is created within the fuel tank 1 due to the fuel vapor being purged, the diaphragm of the negative pressure cut valve 10 is pulled downward to close the negative pressure cut valve 10. In other words, as the pressure in the fuel tank 1 becomes smaller than the atmospheric pressure in the chamber of the negative pressure cut valve 10, the negative pressure cut valve 10 is closed. In this manner, a further decrease in the pressure within the fuel tank 1 is prevented.

A refuel vapor inlet passage 12 is also connected with the chamber a of the canister 2 in order to effectively capture and adsorb the fuel vapor generated while the fuel tank 1 is being refueled.

The refuel vapor inlet passage 12 guides the fuel vapor from a refuel vapor inlet opening 13 to the canister 2. The refuel vapor inlet opening 13 is disposed in the upper interior space of the fuel tank 10. In other words, the refuel vapor inlet opening 13 is located in the space within the fuel tank 1 above the full fuel level.

The refuel vapor inlet opening 13 opens in a downward direction. The refuel vapor inlet opening 13 has a fuel cut valve 14 at its end in order to prevent liquid fuel from flowing into the refuel vapor inlet opening 13 when the fuel level reaches the level of the refuel vapor inlet opening 13.

Furthermore, a refueling control valve 15 is disposed in the refuel vapor inlet passage 12 between the fuel cut valve 14 and the canister 2. The refueling control valve 15 is a diaphragm valve that has a chamber above a diaphragm. The chamber of the refueling control valve 15 is connected to a negative pressure conducting opening 18 through a signal line or passage 19. The negative pressure conducting opening 18 opens near an outer opening of a fuel filler tube 16 for the fuel tank 1. The filler tube 16 is threadedly engageable with a filler cap 17. Except for during refueling, the filler cap 17 is threadedly engaged with the filler tube 16. Thus, the pressure in the chamber of the refueling control valve 15 is in fluid communication with the fuel tank 1 and has substantially the same as the pressure in the fuel tank 1.

When a fuel pump nozzle is inserted into the filler tube 16 and fuel flows into the fuel tank 1, the flow of the fuel generates negative pressure. This negative pressure is transmitted to the chamber of the refueling control valve 15 through the signal passage 19. Accordingly during refueling, the pressure in the chamber above the diaphragm of the refueling control valve 15 decreases, while pressure of the vapor fuel coming from the refuel vapor inlet opening 13 increases due to vapor of the refueled fuel. As a result, the diaphragm of the refueling control valve 15 is pulled in an upward direction to open the refueling control valve 15, so that the fuel vapor from the refueled fuel can be guided into the canister 2 from the refuel vapor inlet 13.

Additionally, the chamber of the refueling control valve 15 can have a spring that biases the diaphragm of the refueling control valve 15 in a downward direction to ensure that the refueling control valve 15 does not inadvertently open. In other words, the diaphragm of the refueling control valve 15 normally held closed, until the flow of the fuel entering the filler tube 16 generates sufficient negative pressure to over come the force of the spring on the diaphragm of the refueling control valve 15.

A circulation tube 20 is disposed near an outer opening of the filler tube 16. The circulation tube 20 supplies fuel vapor from the upper interior space of the fuel tank 1 to the filler tube 16 in order to decrease the amount of external air brought into the filler 16 during refueling.

The air inlet passage 21 is connected to the chamber e of the canister 2. The air inlet passage 21draws air from an air inlet opening 22 into the canister 2. The air inlet opening 22 is located outside the fuel tank 1

An internal purge passage 23*a* extends from the chamber a of the canister 2 to an external purge passage 23*b*, which is outside the fuel tank 1. The external purge passage 23*b* is connected to a suction system of the internal combustion engine. More specifically, the internal purge passage 23*a* is connected to the external purge passage 23*b* via a three-way control valve 30. The external purge passage 23*b* is connected to a downstream of a throttle valve 26 of an inlet pipe 25 via a purge control valve 24. The three-way control valve 30 is also connected to a conducting passage 31. The conducting passage 31 extends from the three-way control valve 30 into the upper interior space of the fuel tank 1. The conducting passage 31 is connected to the fuel vapor inlet passage 7 between the fuel vapor inlet opening 8 and the negative pressure cut valve 10, near the fuel vapor inlet opening 8. In this manner, fuel vapor can be supplied to the internal combustion engine from the fuel tank 1 via either the conducting passage 31 or the canister 2.

A control unit 33 forms leak diagnostic means that preferably includes a microcomputer with a leak diagnostic program that controls the leak diagnosis. The control unit 33 can also include other conventional components such as an input interface circuit, an output interface circuit, and storage devices such as a ROM (Read Only Memory) device and a RAM (Random Access Memory) device. The control unit 33 is operatively coupled to a pressure sensor 32 that measures the pressure within the fuel tank 1. The control unit 33 receives the pressure measurements from the pressure sensor 32 and uses the pressure measurement in the leak diagnosis. The control unit 33 is operatively coupled to control valves 24 and 30 to open and close the purge control valve 24 and shift the mode of the three-way control valve 30.

The purge control valve 24 is normally closed. The purge control valve 24 opens only at the time of purging fuel vapor from the fuel tank 1. The three-way control valve 30 normally lets the fuel vapor flow from the internal purge passage 23*a* to the external purge passage 23*b*. The three-way control valve 30 shifts to a diagnosis mode at the time of the leak diagnosis, in which the fuel vapor flows from the conductive passage 31 to the external purge passage 23*b*.

In the aforesaid construction, while the engine is not in operation, vaporized fuel stays in the fuel tank 1. Upon starting the engine, the fuel vapor in the fuel tank 1 is guided into the canister 2 through the fuel vapor inlet passage 7 to be absorbed in the canister 2. Then, when necessary predetermined conditions for purging are satisfied, the control unit 33 opens the purge control valve 24. For example, the control unit 33 can start the purging after a predetermined period of time elapsed after starting the engine. Of course, other factors can be used to indicate that the necessary predetermined conditions for purging has been met. Consequently, due to the air drawn through the air inlet passage 21 into the suction system of the engine, the fuel vapor stored in the canister 2 is purged toward the suction system of the engine through the purge passages 23*a* and 23*b*. This purged gas containing the fuel vapor is drawn into the inlet pipe 25 through the purge passages 23*a* and 23*b*, and is then burnt inside a combustion chamber of the engine.

The leak diagnostic device for this in-tank canister fuel vapor processing device will now be described. In this leak diagnostic system, the three-way control valve 30, which is preferably a three-way solenoid valve, acts as the fuel tank negative pressure means. The three-way control valve 30 is disposed outside of the fuel tank 1. The three-way control valve 30 normally allows airflow from the canister 2 to the purge control valve 24 by connecting the internal purge passage 23*a* and the external purge passage 23*b*. Upon receiving a signal from the control unit 33, the three-way control valve 30 shifts to a leak diagnosis mode. During the leak diagnosis, the three-way control valve 30 disconnects the airflow from the canister 2 to the purge control valve 24. Instead, the three-way control valve 30 connects the upper interior space of the fuel tank 1 to the purge control valve 24 by connecting the conducting passage 31 and the external purge passage 23*b*. It will be apparent to those skilled in the art from this disclosure that control valves 24 and 30 can be combined into a single valve that is controlled by the control unit 33.

The pressure sensor 32 forms pressure sensing means for sensing the pressure within the upper interior space of the fuel tank 1. The pressure sensor 32 can be any conventional pressure sensor, in which a sensor portion deflects to emit a voltage that corresponds to the pressure. An output signal from the pressure sensor 32 is supplied to the control unit 33, which acts as part of the leak diagnostic means. The microcomputer of the control unit 33 performs leak diagnosis based on the flowchart shown in FIG. 2. The following operations are to be performed while the engine is in operation.

In step S1, it is determined whether predetermined leak diagnostic conditions have been satisfied. Factors in determining whether the predetermined leak diagnostic conditions have been satisfied include the magnitude of negative pressure in the inlet pipe 25, vehicle speed, engine rpm, and openness of the throttle valve. If not, the process is terminated. Otherwise, the control unit 33 proceeds to step S2.

In step S2, in order to start the leak diagnosis, the three-way control valve 30 is shifted to the diagnosis mode. In other words, the control unit 33 disconnects the airflow from the canister 2 to the purge control valve 24, and connects the fuel vapor inlet opening 8 to the purge control valve 24 through the conducting passage 31. Then, the control unit 33 proceeds to step S3, where the purge control valve 24 is opened. By opening the purge control valve 24, the control unit 33 starts a pull-down process, by which negative pressure is created in the fuel tank 1.

By opening the purge control valve 24, the gas is drawn into the suction system. Accordingly, the negative pressure created by the suction in the inlet pipe 25 is transmitted to the upper interior space of the fuel tank 1 through the purge control valve 24, the three-way control valve 30, and the fuel vapor inlet opening 8. Accordingly, the pressure inside the upper interior space of the fuel tank 1 becomes negative.

In the meantime, the interior of the canister 2 is exposed only to the surrounding atmosphere through the air inlet passage 21. In particular, the internal purge passage 23*a* is no longer connected to the external purge passage 23*b*. Therefore, the pressure in canister 2 will not be changed at the internal purge passage 23*a* by the negative pressure created by the suction in the inlet pipe 25. Furthermore, the atmospheric pressure inside the canister 2 is transmitted to the chamber of the negative pressure cut valve 10 through the atmosphere inlet passage 11. Since the pressure in the chamber of the negative pressure cut valve 10 is atmospheric while the pressure of the vapor fuel coming through the vapor inlet opening 8 is negative, the diaphragm in the negative pressure cut valve 10 closes. Accordingly, the pressure in the canister 2 will also not be changed due to the negative pressure caused by the inlet pipe 25 at the negative pressure cut valve 10. Similarly in the refueling control valve 15, the pressure of vapor fuel coming from the refuel vapor inlet 13 is negative, while the pressure in the chamber of the refuel control valve 15 is substantially atmospheric. Accordingly, the refueling control valve 15 is closed as the pull-down process progresses. Hence, the negative pressure of the fuel tank 1 does not affect the pressure inside the canister 2. Therefore, the pressure inside the canister 2 is maintained at a substantially atmospheric pressure.

As described above, in the pull-down process, the control unit 33 creates a situation where the pressure of the interior of the fuel tank 1 is negative, while the pressure of the interior of the canister 2 is a substantially atmospheric pressure.

After the initiation of the pull-down process, the control unit 33 in step S4 reads the pressure in the upper interior space of the fuel tank 1 from the pressure sensor 32. Then, the control unit 33 determines whether the pressure in the upper interior space of the fuel tank 1 has reached a target negative pressure. In other words, the control unit 33 determines whether the pressure in the fuel tank 1 is equal to or smaller than the target negative pressure.

If the pressure within the fuel tank 1 is greater than the target negative pressure, the control unit 33 proceeds to step S5, where the control unit 33 determines whether a predetermined time period T1 has elapsed since the initiation of the pull-down process. If the time period T1 has not elapsed yet, the control unit 33 returns to step S4.

After repeating steps S4 and S5, if the target negative pressure has not been reached after the predetermined time period T1 has elapsed, the control unit 33 proceeds from steps S5 to S10, where it is determined that the in-tank canister system has a leak.

On the other hand, if the pressure within the fuel tank 1 reaches the target negative pressure before the predetermined time period T1 elapses, the control unit 33 proceeds from steps S4 to S6.

In step S6, the purge control valve 24 is closed in order to start a leak-down process. In the leak-down process, since the purge control valve 24 is closed, the negative pressure will be changed if there is a leak in the fuel tank 1 or the canister 2.

Once the purge control valve 24 is closed, the negative pressure should remain the same if there is no leak in the fuel tank 1 or the canister 2. On the other hand, if there is a leak in the system, the negative pressure in the fuel tank 1 should decrease gradually.

If the leak is from the fuel tank 1, the negative pressure in the fuel tank 1 decreases and approaches the atmospheric pressure. Similarly, the negative pressure in the fuel tank 1 also decreases if there is a leak in the canister 2. For example, if there is a hole at a point L of the canister 2 as shown in FIG. 1, the negative pressure of the fuel tank 1 will decrease and approach the atmospheric pressure due to the atmospheric pressure inside the canister 2.

In step S7, it is determined that whether a predetermined time period T2 has elapsed since the leak-down process started. If it has, the control unit 33 proceeds to step S8. Otherwise, the control unit 33 repeats the process in step S7.

In step S8, the control unit 33 obtains the pressure measurement of the upper interior space of the fuel tank 1 from the pressure sensor 32. Then, the control unit 33 compares the measured pressure with a predetermined threshold level pressure TL.

The upper interior space of the fuel tank 1 has negative pressure while the interior of the canister 2 has substantially atmospheric pressure. A leak in the fuel tank 1 decreases the negative pressure in the fuel tank 1, because external air flows into the fuel tank 1 through the leak. Conversely, a leak in the canister 2 decreases the negative pressure in the fuel tank 1 because the gas in the canister 2 leaks out to the fuel tank 1. Therefore, the negative pressure in the fuel tank 1 decreases if there is a leak in either the fuel tank 1 or the canister 2. In other words, a leak in either the fuel tank 1 or the canister 2 can be properly detected based on the pressure in the fuel tank.

If, as a result of the comparison, the measured pressure of the fuel tank 1 is equal to or smaller than the predetermined threshold level pressure TL, the control unit 33 proceeds to step S9, where it is determined that there is no leak in the system.

On the other hand, if the measured pressure of the fuel tank 1 is greater than the predetermined threshold level pressure TL, the control unit 33 proceeds to step S10, where it is determined that there is a leak in the system.

Figure 3:
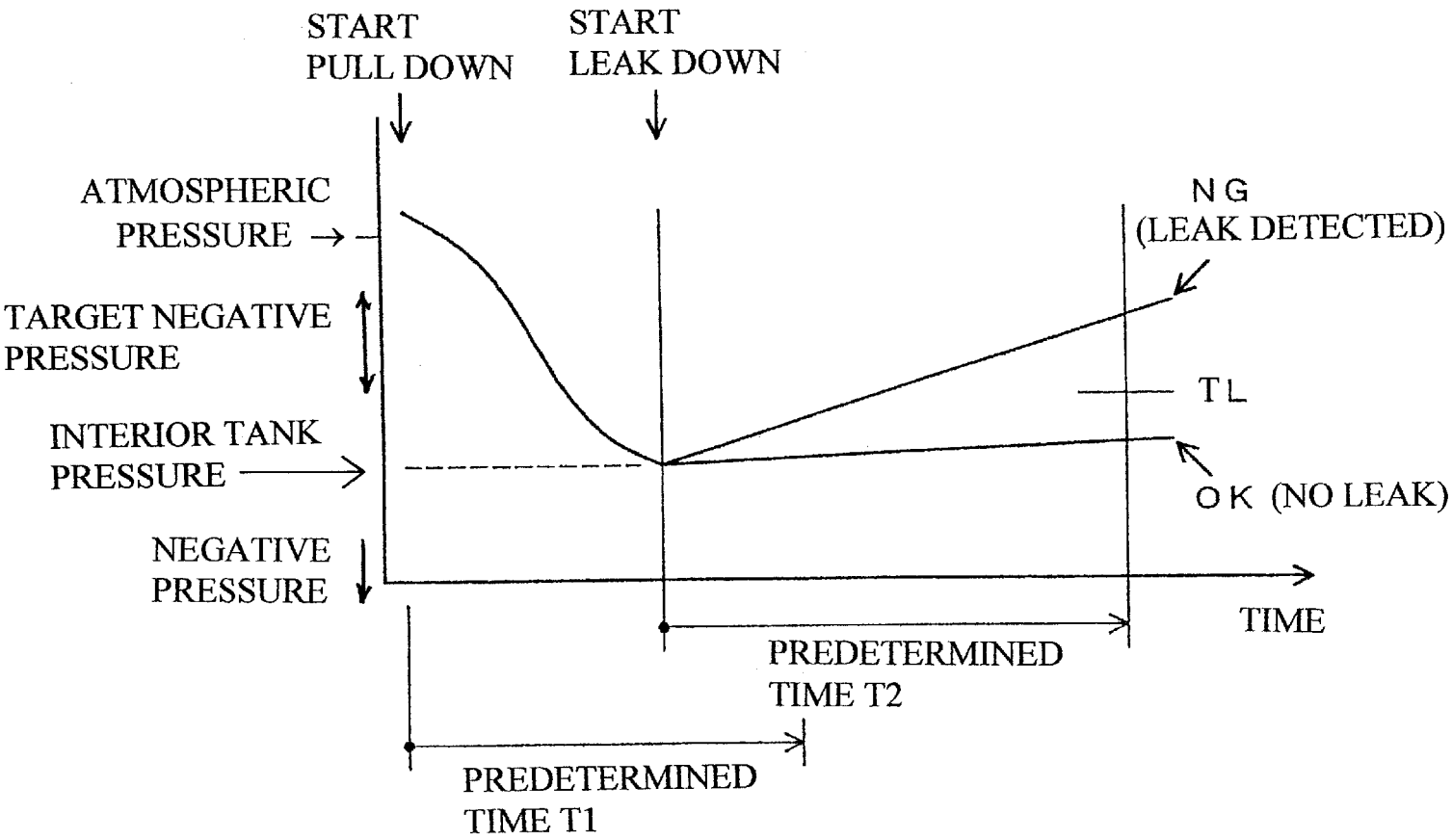
FIG. 3 is a graph showing a change in the pressure within the fuel tank during the leak diagnosis.

That is, as shown in FIG. 3, if the rate of reduction of the negative pressure at the beginning of the leak-down process is smaller than a predetermined value, the system is determined to have no leak. On the other hand, if the rate of reduction of the negative pressure is greater than the predetermined value, it is determined that there is a leak from, for example, a hole having a diameter that corresponds to the rate of reduction of the negative pressure. Accordingly, the system is determined to have a leak.

In the above explanation, T1, T2, TL are to be determined based on various factors such as the capacity of the fuel tank 1 and the magnitude of negative pressure generated by the suction system.

Although it is not mentioned in the flow chart, it should be understood that after the end of the leak diagnosis, the three-way control valve 30 is shifted back to the normal mode. In other words, the connection to the conducting passage 31 is closed, and the canister 2 is connected with the purge control valve 24. At the same time, the compulsory closure of the purge control valve 24 for the purpose of the leak diagnosis is released. The purge control valve 24 is thereafter opened or closed based on the operation of the engine.

With the aforesaid leak diagnosis, both the fuel tank 1 and the canister 2 can be properly checked for leaks based on the pressure within the fuel tank 1.

Furthermore, since the three-way control valve 30 is the only component that is additionally required for the leak diagnosis of the present invention, the present invention provides a leak diagnostic device without increasing the number of the components required. In other words, it is possible to retro-fit existing fuel tanks having an in-tank canister with a leak diagnosis system of the present invention by adding the three-way control valve 30 and reprogramming the control unit 33.

Although the system has the negative pressure cut valve 10, this negative pressure cut valve 10 is used to maintain the pressure in the canister 2 at a substantially atmospheric pressure. Therefore, unlike the conventional leak diagnostic system, the negative pressure cut valve 10 can be utilized for the leak diagnosis without any modifications or changes in the negative pressure cut valve 10.

Furthermore, according to this system, while the engine is not operating, the fuel tank 1 maintains positive or negative pressure at the time when the engine was last turned off, assuming that there is no significant change in the surrounding temperature, and as long as there is no leak. Therefore, by checking the pressure in the fuel tank 1 upon starting the engine and comparing the pressure with the pressure at the time when the engine was last turned off, the system can determine whether there is a leak, without having to operate any other devices. Such leak diagnosis can also be incorporated into this invention.

Second Embodiment

Figure 6:
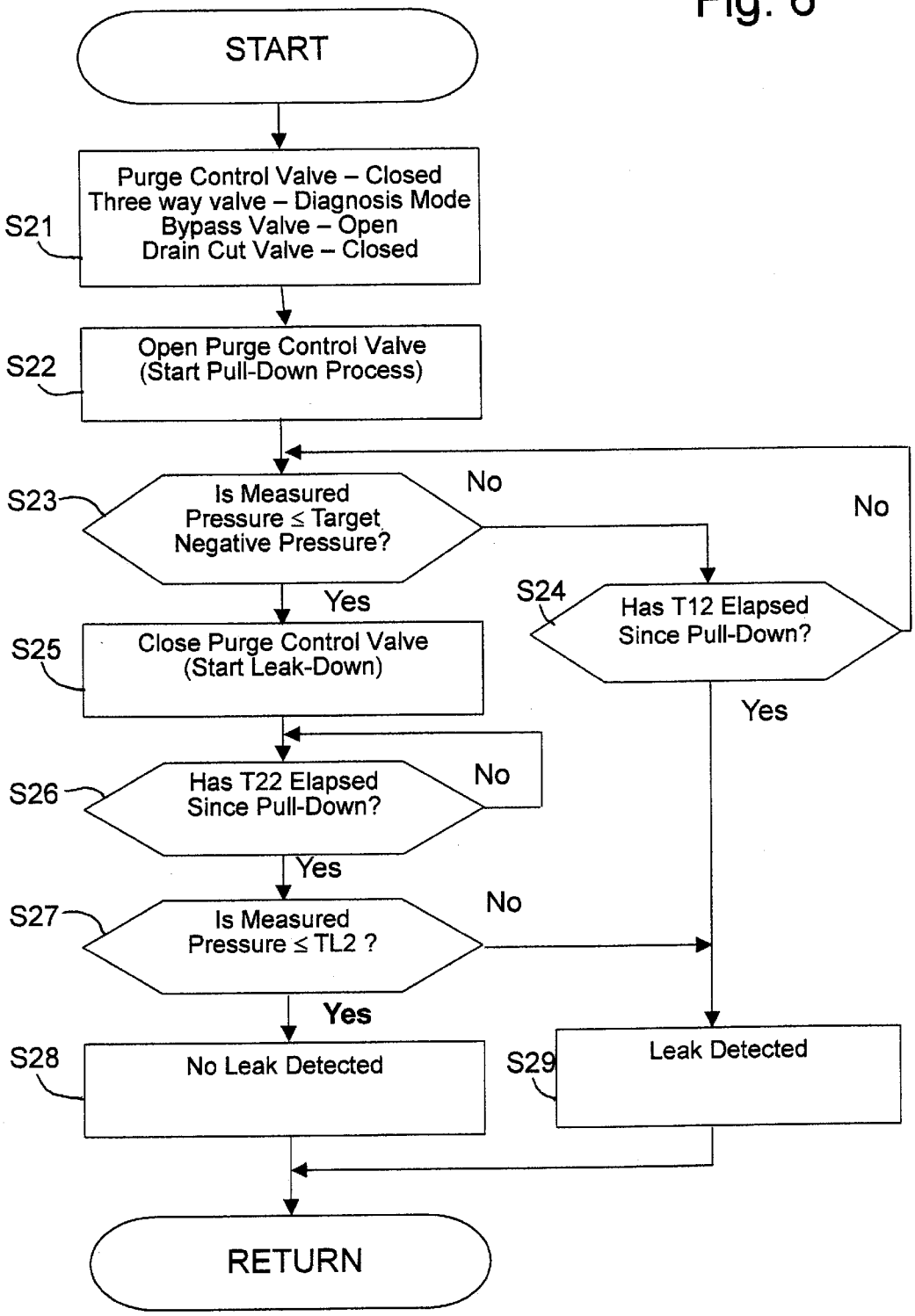
FIG. 6 is a flow chart of the leakage point detection subroutine in accordance with the second embodiment of the present invention.

Referring now to FIGS. 4–6, a second embodiment of the present invention will now be explained. The second embodiment of the present invention is an improvement over the first embodiment discussed above.

In the first embodiment, the pressure in the upper interior space of the fuel tank 1 is reduced to a negative pressure, while the pressure in the canister 2 is maintained at a substantially atmospheric pressure. Then, it is determined whether there is a leak based on the pressure in the fuel tank 1. However, such leak diagnosis can only determine whether there is a leak, but not where the leakage point is. More specifically, the leak diagnosis in the first embodiment cannot determine which of the fuel tank 1 and the canister 2 has the leak.

In view of this shortcoming, the second embodiment of the present invention performs a leakage point diagnosis (diagnosis mode 2) after the leak diagnosis (diagnosis mode 1) determines that there is a leak. In the leakage point diagnosis, the pressure within the canister is reduced to a negative pressure while the pressure within the upper interior space of the fuel tank is reduced to a negative pressure. Thereafter, the leakage point is determined based on the pressure within the fuel tank 1. More specifically, the leakage point diagnosis determines whether the leakage is on external members or on internal members. The external members include the fuel tank 1 and the external pipes that are connected the fuel tank 1 and disposed outside the fuel tank 1. The internal members include the canister 2 and the internal pipes that are connected to the canister 2 and disposed inside the fuel tank 1.

FIG. 4 is a view of the structure of an in-tank canister system having a leak diagnosis function in accordance with the second embodiment of the present invention. In this embodiment, parts that are identical to the ones in the first embodiment are referred to by the identical referential numerals. Operation of such parts can be understood from the explanation of the first embodiment. Only parts that are added in the second embodiment will be explained in detail hereinafter.

A drain cut valve 41 and bypass valve 43 form the canister negative pressure means that reduces the pressure in the canister 2 to a negative pressure when the pressure in the upper interior space of the fuel tank 1 is reduced to a negative pressure.

The drain cut valve 41 is preferably a solenoid cut off valve that is disposed in the air inlet passage 21 between the canister 2 and the air inlet opening 22. The drain cut valve 41 is disposed outside the fuel tank 1. The drain cut valve 41 is usually open.

A bypass path 42 is disposed so as to bypasses the negative pressure cut valve 10 on the fuel vapor inlet passage 7 toward the canister 2. At the same time, the bypass valve 43 is disposed in the bypass path 42. The bypass valve 43 is preferably a solenoid valve that is normally closed. Although the bypass valve 43 is disposed inside the fuel tank 1 according to FIG. 4, the bypass valve 43 may be disposed outside the fuel tank 1.

The opening and closing of the drain cut valve 41 and the bypass valve 43 are controlled by the control unit 33. In this structure, the control unit 33 uses its internal microcomputer to perform leak diagnosis as shown in the flowchart of FIG. 5.

The steps S1–10 of FIG. 5 are the same as in FIG. 2. In other words, the pressure in the upper interior space of the fuel tank 1 is reduced to a negative pressure while the pressure in the canister 2 is kept at a substantially atmospheric pressure. Thereafter, the leak diagnosis (diagnosis mode 1) is performed based on the pressure in the fuel tank 1. At this time, the drain cut valve 41 is kept open, while the bypass valve 43 is kept closed.

The difference in the second embodiment is that, once it has been determined that there is a leak in step S10, the control unit 33 proceeds to step S20 to perform leakage point diagnosis (diagnosis mode 2). In other words, the control unit 33 also functions as leakage point diagnosis means.

If the diagnosis mode 1 determines that there is no leak on either the fuel tank 1 or the canister 2, the diagnosis will be terminated at the end of the diagnosis mode 1. Therefore, in such case, there is no need to take additional time to reduce the pressure in the canister 2 to a negative pressure.

The leakage point diagnosis is performed as a sub-routine of the main leak diagnosis as seen in the flowchart shown in FIG. 6. Now, the leakage point diagnosis will be explained with reference to the flowchart shown in FIG. 6.

In step S21, the purge control valve 24 is closed. The three-way control valve 30 is shifted to the diagnosis mode. In other words, the connection between the canister 2 and the purge control valve 24 is disconnected, and the fuel vapor inlet opening 8 and the purge control valve 24 are connected. Further, the bypass valve 43 that bypasses the negative pressure cut valve 10 on the fuel vapor inlet passage 7 is opened to allow the flow of fuel vapor toward the canister 2. Still further, the drain cut valve 41 is closed to disconnect the airflow through the air inlet passage 21 to the canister 2.

In step S22, the purge control valve 24 is opened to start the second pull-down process. Accordingly, the gas is drawn into the suction in the inlet pipe 25 is transmitted to the upper interior space of the fuel tank 1 through the purge control valve 24, the three-way control valve 30, the conducting passage 31 and the fuel vapor inlet opening 8. As a result, the pressure of the upper interior space of the fuel tank 1 is again reduced to a negative pressure.

At this time, the pressure in the canister 2 is also reduced to a negative pressure. Although the connection between the internal purge passage 23*a* and the external purge passage 23*b* is disconnected at the three-way control valve 30, the vapor fuel inside the canister 2 is purged toward the inlet pipe 25 through the bypass path 42 and the conducting passage 31. Besides, since the drain cut valve 41 is closed, there is no supply of air from the air inlet passage 21 to the canister 2. Accordingly, negative pressure of the inlet pipe 25 and the fuel tank 1 is transmitted to the canister 2 through the conducting passage 31, the fuel vapor inlet opening 8, and the bypass valve 43 that bypasses the negative pressure cut valve 10 on the fuel vapor communication path 7. Therefore, the pressure within the fuel tank 1 and the canister 2 can be reduced to a negative pressure simultaneously.

After the second pull-down process starts, the control unit 33 in step S23 reads the pressure in the upper interior space of the fuel tank 1 from the pressure sensor 32. Then, the control unit 33 determines whether the pressure has reached a target negative pressure. This target negative pressure can be the same pressure as the target negative pressure of the mode 1 diagnosis.

Before the pressure reaches the target negative pressure, the control unit 33 proceeds to step S24 to determine whether a predetermined period of time T12 has elapsed since the beginning of the second pull-down process. If the predetermined period of time T12 has not elapsed, the control unit 33 returns to step S23. This predetermined period of time T12 should be longer than the predetermined period of time T1 of the mode 1 diagnosis. This is because it takes longer to reach the target negative pressure in the diagnosis mode 2, since the pressure within the canister 2 also needs to be reduced.

If the pressure does not reach the target negative pressure after the predetermined period of time T12 has elapsed, the control unit 33 proceeds from steps S24 to S29, where it is determined that the external members have a leak. If the pressure reaches the referential negative pressure before the predetermined period of time T12 elapses, the control unit proceeds from steps S23 to S25. In step S25, the purge control valve 24 is closed to start the second leak-down process.

After closing the purge control valve 24, the negative pressure in the fuel tank 1 decreases toward the atmospheric pressure if the leak is in the external members. Conversely, if the leak is in the internal members, the negative pressure inside the fuel tank 1 hardly changes. Since the fuel tank 1 and the canister 2 have the same negative pressure, the gas in the canister 2 does not leak out of the canister 2, or the gas in the fuel tank 1 does not leak into the canister 2. Therefore, if the negative pressure in the fuel tank 1 hardly changes, the leak is in the internal members.

In step S26, the control unit 33 determines whether a predetermined period of time T22 has elapsed since the beginning of the second leak-down process. When the predetermined period of time T22 has elapsed, the control unit 33 proceeds to step S27.

In step S27, the pressure sensor 32 reads the pressure in the upper interior space of the fuel tank 1. Then the control unit 33 compares the measured pressure with the predetermined threshold level pressure TL2. The predetermined period of time T22 and the predetermined threshold level pressure TL2 should be configured taking into consideration the requisite speed and accuracy of the diagnosis.

As a result of the comparison, if the measured pressure is equal to or smaller than the predetermined threshold level pressure TL2, in other words if the pressure in the fuel tank 1 is equal to or below the predetermined threshold level pressure TL2, the control unit 33 proceeds to step S28. In step S28, the control unit 33 determines that the leakage is on the internal members. In other words, the leak is in the canister 2 or the internal pipes connected to the canister 2.

Conversely, if the detected pressure is greater than the predetermined threshold level pressure TL2, in other words the pressure in the fuel tank 1 is greater than the predetermined threshold level pressure TL2 and closer to the atmospheric pressure, the control unit 33 proceeds to step S29. In step S29, the control unit 33 determines that the leakage is on the external members, in other words on the fuel tank 1 or the external pipes connected to the fuel tank 1.

To recapitulate, if the rate of reduction of the negative pressure in the fuel tank 1 is small, the leakage is on the internal members. If the rate of reduction is great, the leakage is on the external members. In this manner, the leakage point is determined.

In the above explanation, T12, T22, TL2 are to be determined based on various factors such as the capacity of the fuel tank 1 and the magnitude of negative pressure generated by the suction system.

Although it is not shown in the flowchart, after the end of the leakage point diagnosis, the three-way control valve 30 is shifted back to the normal operation mode. More specifically, the conducting passage 31 is closed, and the canister 2 and the purge control valve 24 are connected. The bypass valve 43 is closed. The drain cut valve 41 is opened. The purge control valve 24 is shifted back to the normal operation so as to be opened/closed according to the operation of the engine. By performing the diagnosis in the aforesaid manner, it is possible to determine based on the pressure in the fuel tank 1 whether the leakage is on external members such as the fuel tank 1 or on internal members such as the canister 2.

The terms of degree such as "substantially", "about" and "approximately" as used herein mean a reasonable amount of deviation of the modified term such that the end result is not significantly changed. These terms should be construed as including a deviation of ±25% of the modified term if this would not negate the meaning of the word it modifies.

This application claims priority to Japanese Patent Application Nos. H11-226148 and H2000-164404. The entire disclosures of Japanese Patent Application Nos. H11-226148 and H2000-164404 are hereby incorporated herein by reference.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing description of the embodiments according to the present invention are provided for illustration only, and not for the purpose of limiting the invention as defined by the appended claims and their equivalents. Thus, the scope of the invention is not limited to the disclosed embodiments.

What is claimed is:

1. A leak diagnostic device for an in-tank canister system connected to a suction system of an internal combustion engine, said in-tank canister system having a fuel tank, a vapor absorbing canister, a fuel vapor inlet passage fluidly connecting a fuel vapor inlet opening disposed in an upper interior space of the fuel tank to the canister via a negative pressure cut valve, an air inlet passage drawing air into the canister through an air inlet opening disposed outside the fuel tank, and a purge passage purging the fuel vapor along with air out of the canister into the suction system of the internal combustion engine via a purge control valve, said leak diagnostic device comprising:

a negative pressure control valve being arranged to operatively connect and disconnect the suction system between the canister in a normal mode and the upper interior space of the fuel tank in a diagnosis mode; and a control unit having a pressure sensor arranged to measure pressure in the upper interior space of the fuel tank, said control unit being operatively coupled to said negative pressure control valve to shift said negative pressure control valve between said normal mode and said diagnosis mode, said control unit being configured to open the purge control valve with said negative pressure control valve in said normal mode to create a negative pressure in the fuel tank and to determine whether there is a leak based on the pressure measured by said pressure sensor.

2. The leak diagnostic device as set forth in claim 1, wherein said negative pressure control valve is a three-way solenoid valve.

3. The leak diagnostic device as set forth in claim 1, wherein said negative pressure control valve is disposed outside the fuel tank.

4. The leak diagnostic device as set forth in claim 3, wherein said control unit is configured to shift the purge control valve from an open position to a closed position for a predetermined period of time after the pressure in the fuel tank reaches a first target negative pressure; and said control unit is configured to obtain a measurement of the pressure in the fuel tank from said pressure sensor after the predetermined period of time elapses, and to determine whether there is a leak based on the measured pressure.

5. The leak diagnostic device as set forth in claim 4, wherein said negative pressure control valve is connected to the fuel tank via a passage that is connected to the fuel vapor inlet passage between the fuel vapor inlet opening and the negative pressure cut valve.

6. The leak diagnostic device as set forth in claim 4, further comprising a drain cut valve disposed on the air inlet passage and having an open position and a closed position;

a bypass path disposed in the fuel vapor inlet passage to bypass the negative pressure cut valve with a bypass valve disposed in said bypass path;

said control unit being configured to control said drain cut valve and said bypass valve to determine a leakage point.

7. The leak diagnostic device as set forth in claim 6, wherein said control unit is configured to shift said negative pressure control valve to said diagnosis mode, to open the purge control valve, to close said drain cut valve position, and to open said bypass valve to reduce the pressure in the fuel tank and the canister to a second target negative pressure, if said control unit has determined a leak exists.

8. The leak diagnostic device as set forth in claim 7, wherein said control unit is configured to close the purge control valve for a predetermined period after the pressure in the fuel tank reaches the second target negative pressure; and said control unit is configured to obtain a measurement of the pressure in the fuel tank from said pressure sensor after the predetermined period of time elapses, and determine the leakage point based the measured pressure.

9. A leak diagnostic device for an in-tank canister system connected to a suction system of an internal combustion engine, said leak diagnostic system comprising:

a fuel tank;

a fuel vapor absorbing canister disposed within said fuel tank to receive fuel vapor from said fuel tank;

a fuel vapor inlet passage fluidly connecting a fuel vapor inlet opening disposed in an upper interior space of said fuel tank to said canister;

a negative pressure cut valve disposed between said fuel vapor inlet opening and said canister to control fuel vapor flowing from said fuel vapor inlet opening to said canister;

an air inlet passage fluidly connecting said canister to an air inlet opening exposed to air outside of said fuel tank;

a negative pressure control valve being arranged to operatively connect and disconnect the suction system between said canister in a normal mode and said upper interior space of said fuel tank in a diagnosis mode;

a purge control valve disposed between said fuel tank and the suction system to control a flow of fuel vapor from said canister and said fuel tank to the suction system, said purge control valve having an open position and a closed position; and a control unit having a pressure sensor arranged to measure pressure in said upper interior space of said fuel tank, said control unit being operatively coupled to said negative pressure control valve to shift said negative pressure control valve between said normal mode and said diagnosis mode, said control unit being configured to open the purge control valve with said negative pressure control valve in said normal mode to create a negative pressure in the fuel tank and to determine whether there is a leak based on the pressure measured by said pressure sensor.

10. The leak diagnostic device as set forth in claim 9, wherein said negative pressure control valve is a three-way solenoid valve.

11. The leak diagnostic device as set forth in claim 9, wherein said negative pressure control valve is disposed outside said fuel tank.

12. The leak diagnostic device as set forth in claim 9, wherein said control unit is configured to shift the purge control valve from an open position to a closed position for a predetermined period of time after the pressure in said fuel tank reaches a first target negative pressure; and said control unit is configured to obtain a measurement of the pressure in said fuel tank from said pressure sensor after the predetermined period of time elapses, and to determine whether there is a leak based on the measured pressure.

13. The leak diagnostic device as set forth in claim 12, further comprising a drain cut valve disposed on said air inlet passage and having an open position and a closed position;

a bypass path disposed in said fuel vapor inlet passage to bypass said negative pressure cut valve with a bypass valve disposed in said bypass path;

said control unit being further configured to control said drain cut valve and said bypass valve to determine a leakage point.

14. The leak diagnostic device as set forth in claim 13, wherein said control unit is configured to shift said negative pressure control valve to said diagnosis mode, to open said purge control valve, to close said drain cut valve position, and to open said bypass valve to reduce the pressure in said fuel tank and said canister to a second target negative pressure, if said control unit has determined that a leak exists.

15. The leak diagnostic device as set forth in claim 14, wherein said control unit is configured to close said purge control valve for a predetermined period of time after the pressure in said fuel tank reaches the second target negative pressure; and said control unit being configured to obtain a measurement of the pressure in said fuel tank from said pressure sensor after the predetermined period of time elapses, and to determine the leakage point based the measured pressure.

16. A leak diagnostic device for an in-tank canister system connected to a suction system of an internal combustion engine, said in-tank canister system having a fuel tank, a vapor absorbing canister, a fuel vapor inlet passage fluidly connecting a fuel vapor inlet opening disposed in an upper interior space of the fuel tank to the canister via a negative pressure cut valve, an air inlet passage drawing air into the canister through an air inlet opening disposed outside the fuel tank, and a purge passage purging the fuel vapor along with the air out of the canister into the suction system of the internal combustion engine via a purge control valve, said leak diagnostic device comprising:

fuel tank negative pressure means for creating negative pressure in said fuel tank by connecting the suction system of the engine with the upper interior space of the fuel tank, and for maintaining substantially atmospheric pressure in an interior of the canister via bypassing the canister from the suction system; and leak diagnostic means for determining whether a leak exists in one of the fuel tank and the canister, said leak diagnostic means having pressure sensor arranged to measure pressure in the upper interior space of the fuel tank, said leak diagnostic means determining whether there is a leak based on the measured pressure.

17. The leak diagnostic device as set forth in claim 16, wherein said fuel tank negative pressure means reduces the pressure in the upper interior space of the fuel tank while maintaining the pressure in the canister at a substantially atmospheric pressure.

18. The leak diagnostic device as set forth in claim 16, further comprising canister negative pressure means for reducing a pressure in the canister to a negative pressure when the pressure in the fuel tank is being reduced to a negative pressure, said canister negative pressure means reducing the pressure in the canister to a negative pressure when said control unit has determined that there is a leak; and leakage point detection means for determining the leakage point based on the pressure measured by said pressure sensor.

19. A method for diagnosing a leak in a fuel tank with in-tank vapor absorbing canister system that is connected to a suction system of an internal combustion engine, the method comprising:

creating negative pressure in an interior space of the fuel tank via the suction system of the internal combustion engine;

maintaining pressure in an interior space of the canister at substantially atmospheric pressure;

measuring pressure within the interior space of the fuel tank; and determining whether a leak exists in one of the fuel tank and the canister based on the measured pressure.

20. A method according to claim 19, further comprising creating negative pressure in the interior space of the canister and the fuel tank upon determination of a leak in one of the fuel tank and the canister, and measuring pressure within the interior space of the fuel tank after said creating negative pressure in the canister and the fuel tank.

* * * * *